US006954036B2

(12) United States Patent
Moisin

(10) Patent No.: US 6,954,036 B2
(45) Date of Patent: Oct. 11, 2005

(54) CIRCUIT HAVING GLOBAL FEEDBACK FOR PROMOTING LINEAR OPERATION

(76) Inventor: Mihail S. Moisin, 8 Druce St., Brookline, MA (US) 02445

( * ) Notice: Subject to any disclaimer, the term of this patent is extended or adjusted under 35 U.S.C. 154(b) by 0 days.

(21) Appl. No.: 10/685,781

(22) Filed: Oct. 15, 2003

(65) Prior Publication Data

US 2004/0183466 A1 Sep. 23, 2004

Related U.S. Application Data

(60) Provisional application No. 60/455,752, filed on Mar. 19, 2003.

(51) Int. Cl.[7] ..... H05B 37/00

(52) U.S. Cl. ..... 315/224; 315/307; 315/DIG. 5; 315/DIG. 7

(58) Field of Search ..... 315/307, 224, 315/246, DIG. 5, DIG. 7

(56) References Cited

U.S. PATENT DOCUMENTS

| | | | |
|---|---|---|---|
| 3,859,555 | A | 1/1975 | Latassa et al. |
| 4,580,013 | A | 4/1986 | Moisin |
| 4,829,567 | A | 5/1989 | Moisin |
| 4,864,609 | A | 9/1989 | Moisin |
| 4,922,531 | A | 5/1990 | Moisin |
| 5,014,305 | A | 5/1991 | Moisin |
| 5,052,039 | A | 9/1991 | Moisin |
| 5,081,401 | A | 1/1992 | Moisin |
| 5,124,619 | A | 6/1992 | Moisin et al. |
| 5,138,233 | A | 8/1992 | Moisin et al. |
| 5,138,234 | A | 8/1992 | Moisin |
| 5,138,236 | A | 8/1992 | Bobel et al. |
| 5,144,195 | A | 9/1992 | Konopka et al. |
| 5,148,087 | A | 9/1992 | Moisin et al. |
| 5,220,247 | A | 6/1993 | Moisin |
| 5,332,951 | A | 7/1994 | Turner et al. |
| 5,583,402 | A | 12/1996 | Moisin et al. |
| 5,608,295 | A | 3/1997 | Moisin |
| 5,686,799 | A | 11/1997 | Moisin et al. |
| 5,691,606 | A | 11/1997 | Moisin et al. |
| 5,798,617 | A | 8/1998 | Moisin |
| 5,821,699 | A | 10/1998 | Moisin |
| 5,866,993 | A | 2/1999 | Moisin |
| 5,877,926 | A | 3/1999 | Moisin |
| 5,925,986 | A | 7/1999 | Moisin |
| 5,955,841 | A | 9/1999 | Moisin et al. |
| 5,982,111 | A | 11/1999 | Moisin |
| 6,011,362 | A | 1/2000 | Moisin |
| 6,020,688 | A | 2/2000 | Moisin |
| 6,028,399 | A | 2/2000 | Moisin |
| 6,037,722 | A | 3/2000 | Moisin |
| 6,051,936 | A | 4/2000 | Qian |
| 6,069,455 | A | 5/2000 | Moisin |
| 6,091,288 | A | 7/2000 | Moisin |
| 6,100,645 | A | 8/2000 | Moisin |
| 6,100,648 | A | 8/2000 | Moisin |
| 6,107,750 | A | 8/2000 | Moisin |
| 6,122,182 | A | 9/2000 | Moisin |
| 6,127,786 | A | 10/2000 | Moisin |
| 6,137,233 | A | 10/2000 | Moisin |
| 6,157,142 | A | 12/2000 | Moisin |
| 6,160,358 | A | 12/2000 | Moisin |
| 6,169,375 | B1 | 1/2001 | Moisin |
| 6,181,082 | B1 | 1/2001 | Moisin |
| 6,181,083 | B1 | 1/2001 | Moisin |
| 6,188,553 | B1 | 2/2001 | Moisin |
| 6,194,843 | B1 | 2/2001 | Moisin |
| 6,222,326 | B1 | 4/2001 | Moisin |
| 6,236,168 | B1 | 5/2001 | Moisin |
| 6,281,638 | B1 | 8/2001 | Moisin |
| 2002/0011806 | A1 | 1/2002 | Moisin |
| 2002/0030451 | A1 | 3/2002 | Moisin |
| 2003/0160571 | A1 | 8/2003 | Moisin |

*Primary Examiner*—David Vu
(74) *Attorney, Agent, or Firm*—Daly, Crowley, Mofford & Durkee, LLP

(57) ABSTRACT

A resonant circuit includes a global feedback path from a load to diode elements and an LC notch filter at an input terminal to block energy from the feedback signal going back out on the line. The LC notch filter is tuned to about the frequency of the feedback signal.

19 Claims, 6 Drawing Sheets

CIRCUIT HAVING GLOBAL FEEDBACK FOR PROMOTING LINEAR OPERATION

CROSS REFERENCE TO RELATED APPLICATIONS

The present application claims the benefit of U.S. Provisional Patent Application No. 60/455,752, filed on Mar. 19, 2003, which is incorporated herein by reference.

STATEMENT REGARDING FEDERALLY SPONSORED RESEARCH

Not Applicable.

FIELD OF THE INVENTION

The present invention relates generally to electrical circuits and, more particularly, to electrical circuits for controlling power to a load.

BACKGROUND OF THE INVENTION

As is known in the art, there are a variety of circuits for energizing a load that attempt to improve the overall circuit performance. Some circuits utilize feedback from a load to bias components, such as diodes, to the conductive state to enable more efficient charging of storage capacitors, for example. Exemplary power control, dimming, and/or feedback circuits are shown and described in U.S. Pat. Nos. 5,686,799, 5,691,606, 5,798,617, and 5,955,841, all of which are incorporated herein by reference.

FIG. 1 shows an exemplary prior art resonant circuit having a feedback path FB via a series capacitor Cs to a point PFB between diodes D1, D2 that form a voltage doubler circuit. An input filter IF includes an inductor L1 and a capacitor C1 to limit the energy from the resonant circuit that goes back out on the line via the input terminals, which can correspond to conventional white and black wires WHT, BLK. While the voltage level of the feedback signal applied to the diodes D1, D2 can be increased by resonance between the various LC elements CF, LR1, LR2, the amount of feedback is limited to an acceptable amount of electromagnetic interference generated by a portion of the feedback signal flowing back out through the input inductor L1 and capacitor C1. That is, some known circuits having feedback from the load can generate significant Electromagnetic Conductive interference (EMC) that degrades circuit performance and limits use of the feedback.

It would, therefore, be desirable to overcome the aforesaid and other disadvantages.

SUMMARY OF THE INVENTION

The present invention provides a resonant circuit using feedback from a load to promote linear operation of rectifying diodes while limiting electromagnetic conduction interference from the feedback signal. With this arrangement, the entire high frequency load feedback signal can be used to maintain rectifying diodes in a conductive state so as to make non-linear loads appear linear. While the invention is primarily shown and described in conjunction with a ballast circuit energizing a fluorescent lamp, it is understood that the invention is applicable to circuits in general in which a feedback signal can enhance circuit performance.

In one embodiment, a circuit includes first and second input terminals for receiving an AC input signal and an input inductor having a first end coupled to the first terminal. The circuit further includes a feedback path for transferring a signal from a load to a second end of the first inductor and a blocking capacitor coupled in parallel with the input inductor so as to form a notch filter tuned to a frequency of the load signal on the feedback path. With this arrangement, the entire load current can be provided as feedback to rectifying diodes to promote linear operation of the diodes while the notch filter blocks energy from the feedback signal from going back out onto the line.

In another aspect of the invention, a circuit, such as a resonant ballast circuit, includes a load inductor inductively coupled to a resonant inductor and a Positive Temperature Coefficient (PTC) element that combine to provide a soft start for a load, which can correspond to a fluorescent lamp.

BRIEF DESCRIPTION OF THE DRAWINGS

The invention will be more fully understood from the following detailed description taken in conjunction with the accompanying drawings, in which.

DETAILED DESCRIPTION OF THE INVENTION

Figure 1:
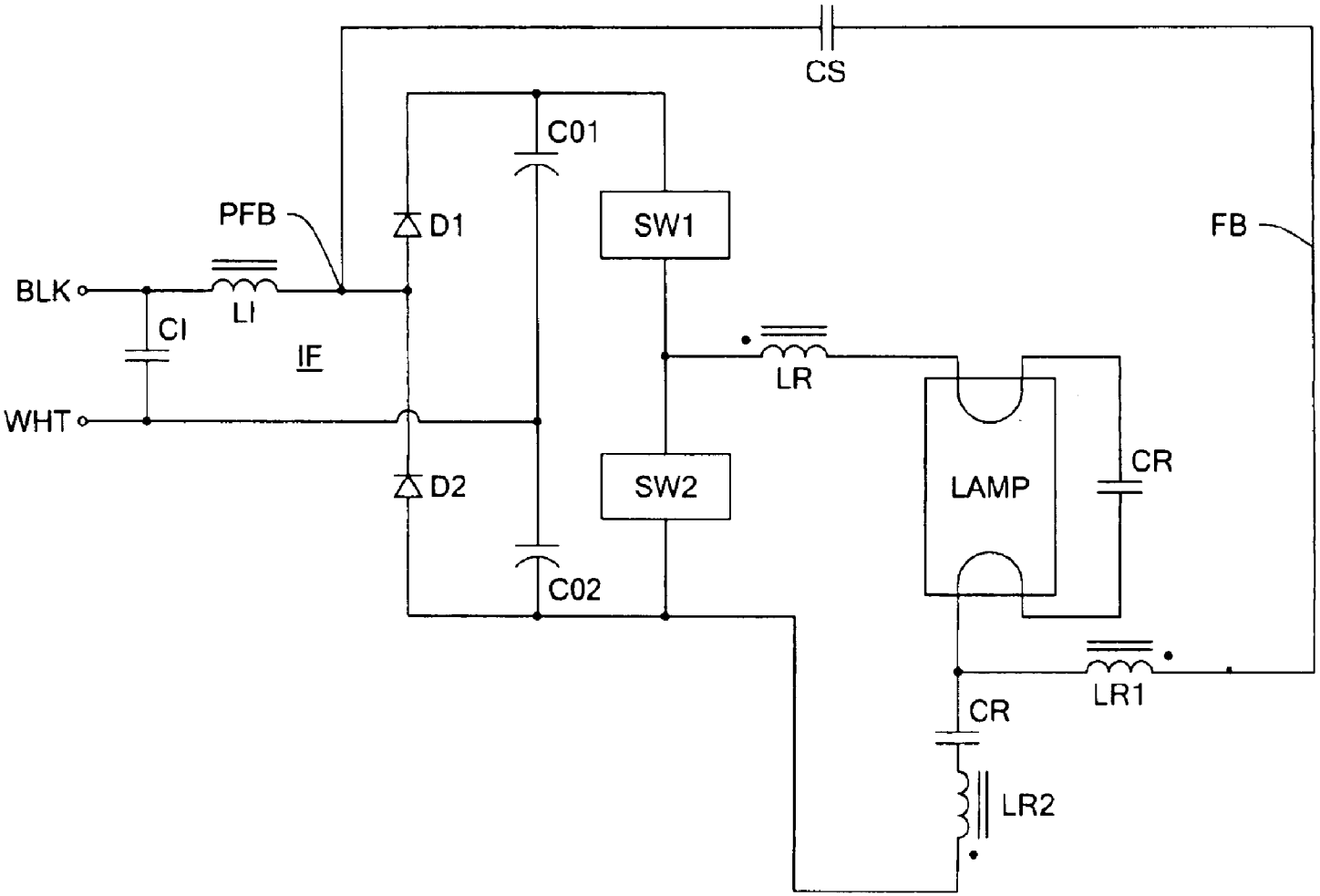
FIG. 1 (PRIOR ART)
FIG. 1 is a schematic diagram of a prior art circuit having feedback from a load.
Figure 2:
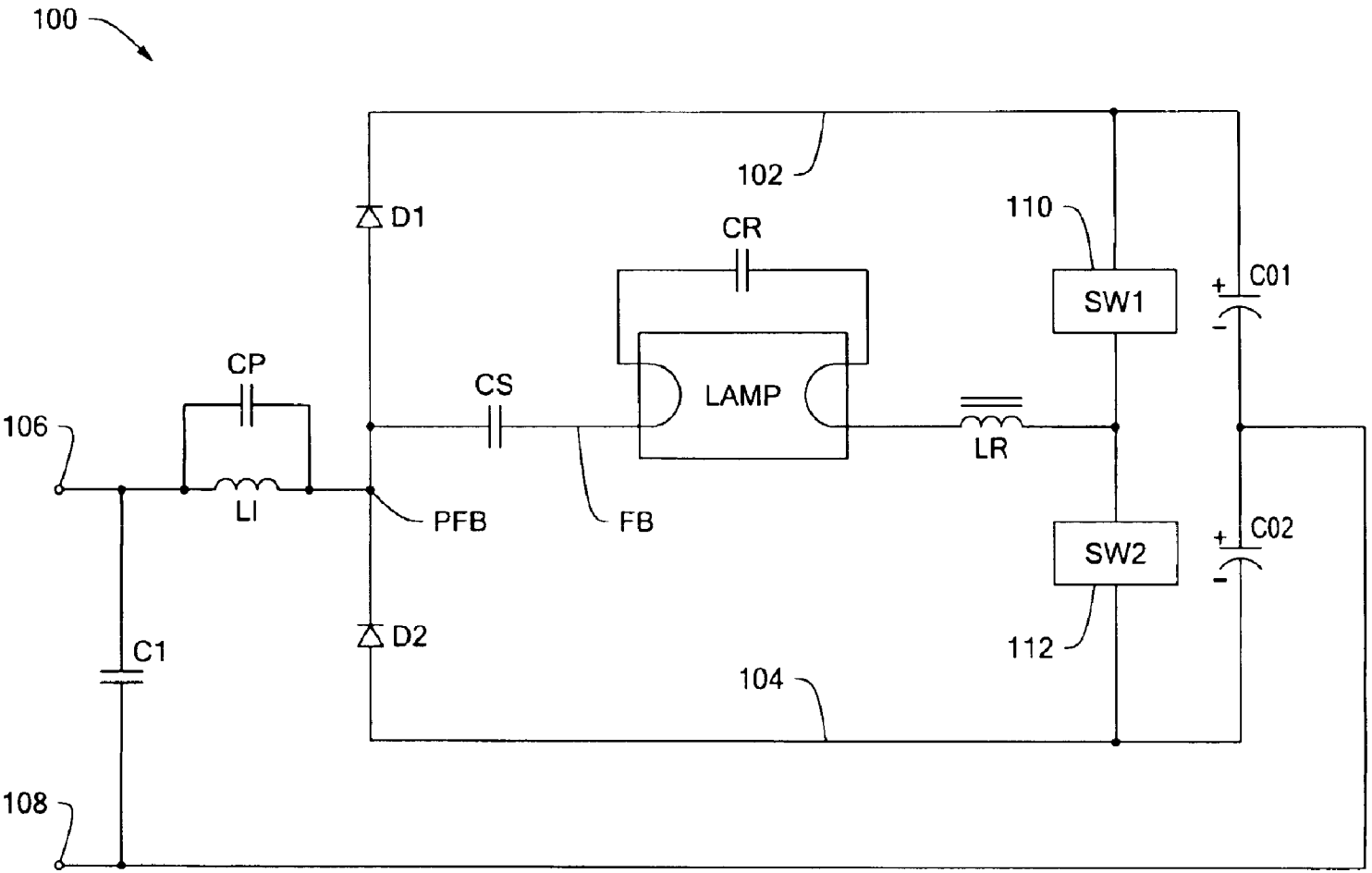
FIG. 2 is a schematic depiction of a circuit having a feedback path in accordance with the present invention.

FIG. 2 shows an exemplary circuit 100 having a feedback path FB from the load LD, here shown as a fluorescent lamp (a non-linear load), to a point PFB between first and second diodes D1, D2 coupled across first and second rails 102, 104 in a voltage doubler configuration. The feedback path FB can include a series capacitor CS coupled between the load LD and the feedback point PFB.

First and second storage capacitors C01, C02 are coupled end-to-end across the rails 102, 104. A first input terminal 106, which can correspond to a conventional black wire, is coupled via an input inductor L1 to the feedback point PFB between the diodes D1, D2. A second input terminal 108, which can correspond to a conventional white wire, is coupled to a point between the first and second capacitors C01, C02. An input capacitor C1 can be coupled between the first and second terminals 106, 108.

In one particular embodiment, the resonant circuit 100 includes first and second switching elements 110, 112 coupled in a half bridge configuration for energizing a load. The resonant circuit 100 includes a resonant inductor LR, a resonant capacitor CR, and a load LD, such as a fluorescent lamp. It is understood that the load can be provided from a wide variety of resonant and non-resonant, linear and non-linear circuits, devices and systems. It is further understood that the switching elements can be provided in a variety of topologies, such as full bridge arrangements, without departing from the present invention. In addition, the switching elements can be selected from a wide variety of device types well known to one of ordinary skill in the art.

The circuit 100 further includes a blocking capacitor CP coupled in parallel across the input inductor L1. The impedance of the blocking capacitor CP is selected to resonate in parallel with the input inductor L1 at a frequency of the feedback signal, which corresponds to an operating frequency of the load. The blocking capacitor CP and the input inductor L1 provide a notch filter at the frequency of the feedback signal so as to block energy from the feedback signal from going back out onto the line through the input terminals 106, 108. The notch filter allows minimal current flow from the feedback signal through the input capacitor C1 and input inductor L1.

Since the path back out onto the line is blocked, substantially all of the feedback signal energy, which can correspond to the entire load current, is directed to maintaining the diodes D1, D2 in a conductive state. The high frequency feedback signal biases the diodes D1, D2 to the conductive state, which facilitates the flow of energy from the line to the storage capacitors C01, C02. With this arrangement, a non-linear load appears to be linear.

Figure 3:
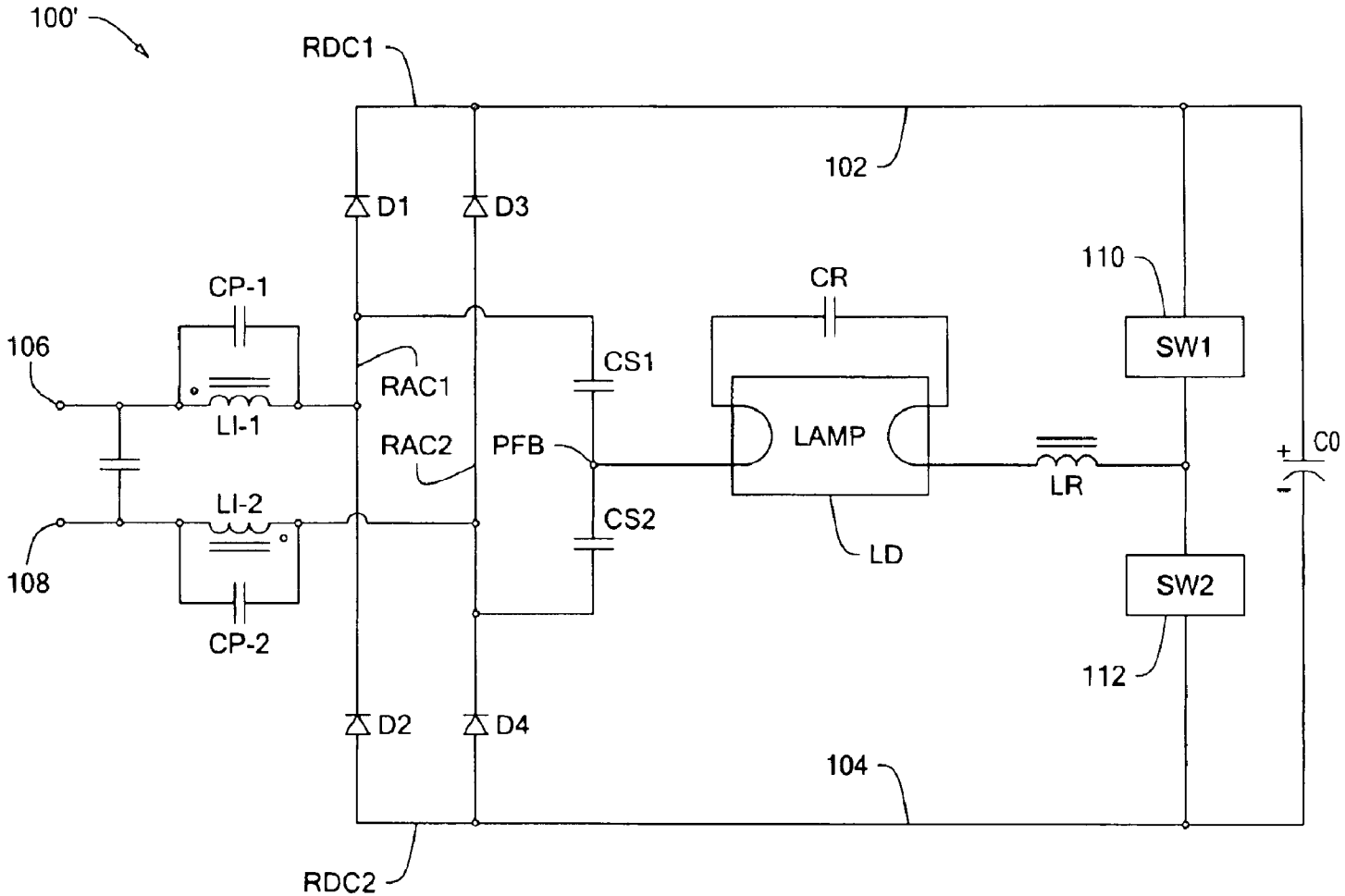
FIG. 3 is a schematic depiction of a further circuit having a feedback path in accordance with the present invention.

FIG. 3 shows another embodiment 100' having enhanced linear operation similar to that of FIG. 2, where like reference designations indicate like elements. The circuit 100' includes a full bridge rectifier D1, D2, D3, D4 having first and second series capacitors CS1, CS2 coupled end-to-end between AC terminals RAC1, RAC2 of the rectifier. A storage capacitor CO is coupled across the DC rails RDC1, RDC2. A feedback path FB extends from the load LD, here shown as a lamp, to a point PFB between the first and second series capacitors C1, C2.

A first input inductor L1-1 is located at the first input terminal 106 and a second input inductor L1-2, which can be inductively coupled with the first input inductor L1-1, is located at the second input terminal 108. It is understood that the input inductors L1-1, L1-2 can be coupled or independent depending upon the needs of a particular application. A first blocking capacitor CP-1 is coupled in parallel with the first input inductor L1-1 to form a notch filter tuned to the feedback signal from the load LD. A second blocking capacitor CP-2 is coupled in parallel with the second input inductor L1-2 to also form a notch filter tuned to the feedback signal.

In one particular embodiment, the impedance of the first and second input inductors L1-2, L1-2 are substantially the same and the impedance of the first and second blocking capacitors CP-1, CP-2 is substantially the same.

With this arrangement, energy from the feedback signal FB is directed to maintaining the full bridge rectifier diodes D1–D4 in the conductive state since the notch filters L1-1, CP-1 and L1-2, CP-2 block energy from the feedback signal from going back out on the line and thereby minimize EMC levels.

Figure 4:
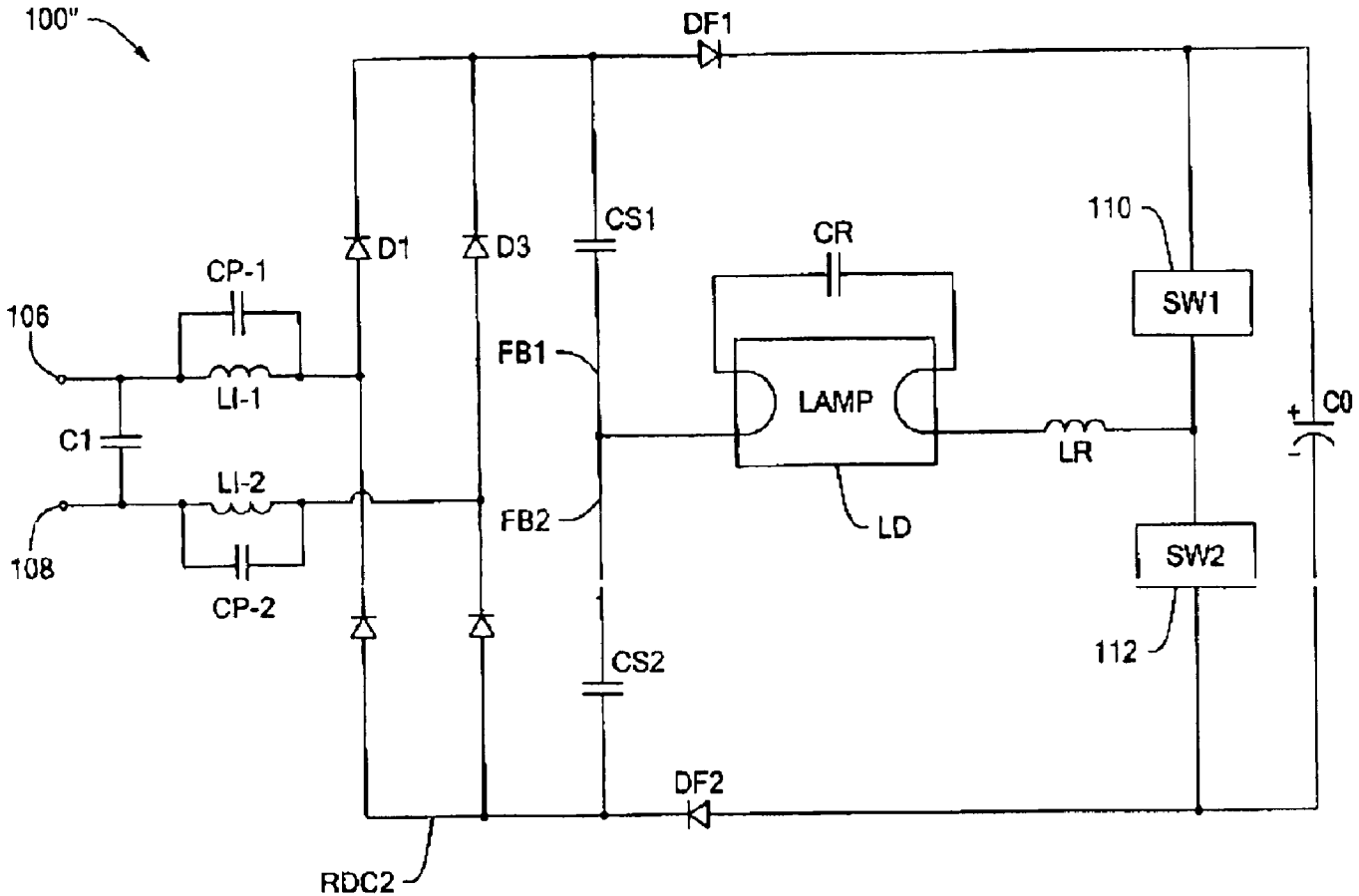
FIG. 4 is a schematic depiction of another circuit having a feedback path in accordance with the present invention.

FIG. 4 shows another embodiment 100" having enhanced linear operation similar to that of FIG. 3, where like reference designations indicate like elements. The circuit 100" includes first and second feedback paths FB1, FB2 from the load LD to respective first and second DC terminals RDC1, RDC2 of the full bridge rectifier D1–D4. The first feedback path FB1 includes a first series capacitor CS1 and the second feedback path FB2 includes a second series capacitor CS2. The circuit 100" further includes a first bridge diode DF1 coupled between the first feedback point RDC1 and the first switching element 110 and a second bridge diode DF2 coupled between second feedback point RDC2 and the second switching element 112.

With this arrangement, the entire feedback from the load can be provided to the rectifying diodes to promote linear operation of the rectifying diodes D1–D4. Notch filters provided by parallel LC resonant circuits tuned to the frequency of the feedback signal enable the entire load signal to be fed back since the notch filter reduces the EMC energy going back out on the line to acceptable levels, even under applicable residential standards.

While the exemplary embodiments show a circuit having EMC-reducing notch filters as parallel resonant LC circuits, it is understood that other resonant circuits can be used to provide the notch filter.

In a further aspect of the invention, a ballast circuit includes a load inductor inductively coupled with a resonant inductor, a resonant capacitor, and a positive temperature coefficient (PTC) element, that combine to promote a soft start sequence for a lamp. With this arrangement preferred voltage and current start up levels are provided to a fluorescent lamp, for example.

Figure 5:
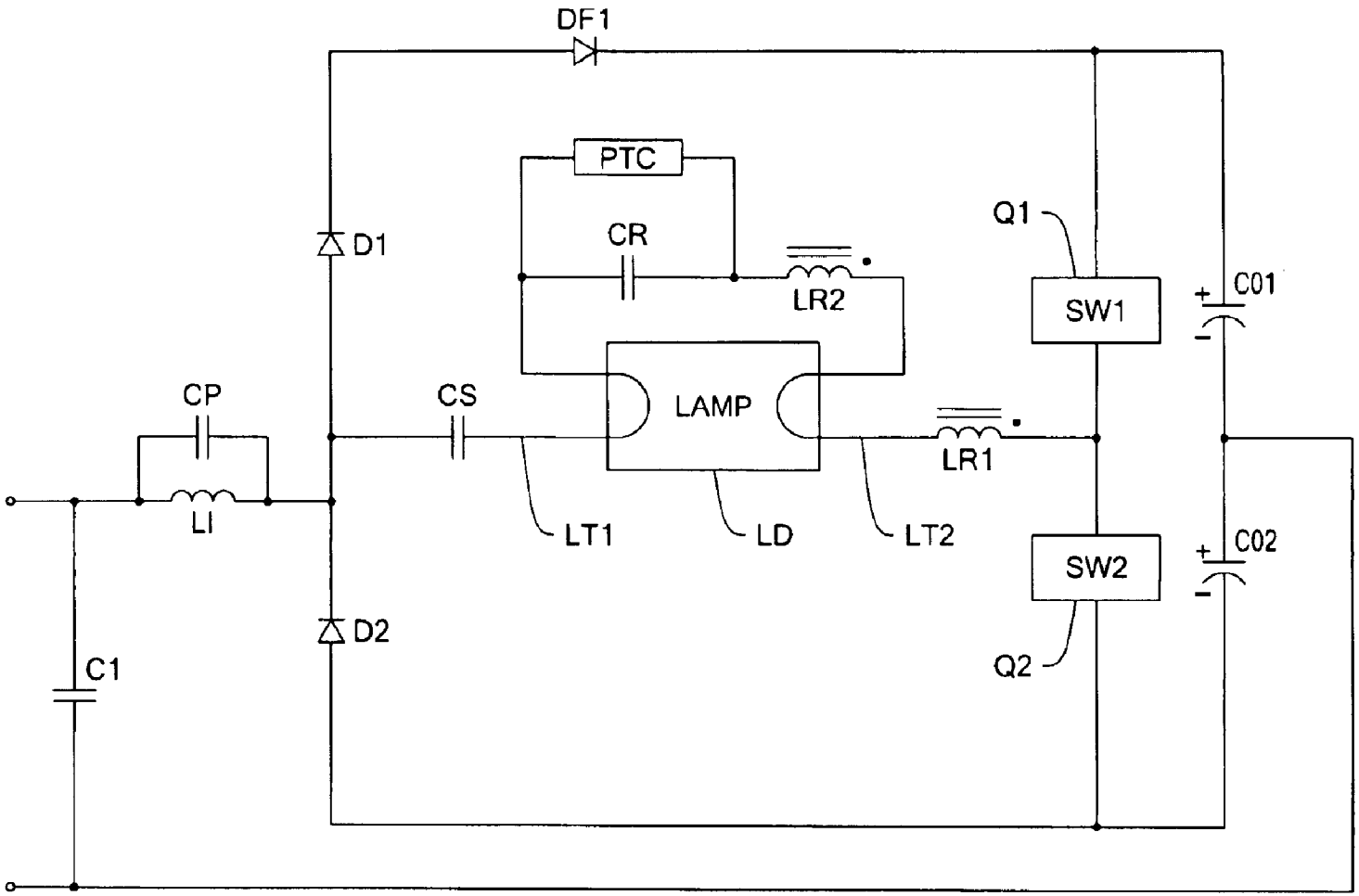
FIG. 5 is a schematic depiction of a circuit providing a soft start in accordance with the present invention.

FIG. 5 shows an exemplary resonant circuit 200, here shown as a ballast circuit, having a lamp start up sequence in accordance with the present invention. The circuit 200 includes a resonant inductor LR1 coupled between first and second switching elements Q1, Q2 coupled in a half-bridge topology. The circuit can further include a conventional input stage having voltage doubler diodes D1, D2, storage capacitors C01, C02, and an LC input filter.

It is understood that the circuit can include various topologies without departing from the present invention. It is further understood that the switching elements can be provided from a wide range of device types well known to one of ordinary skill in the art.

The exemplary circuit 200 further includes first and second load terminals LT1, LT2 across which a load LD, such as a fluorescent lamp, can be energized via a current flow. A resonant capacitor CR and a load inductor LR2 are coupled end-to-end across the first and second load terminals LT1, LT2. The load inductor LR2 is inductively coupled to the resonant inductor LR1. A PTC element PTC is coupled in parallel with the resonant capacitor CR.

Figure 6:
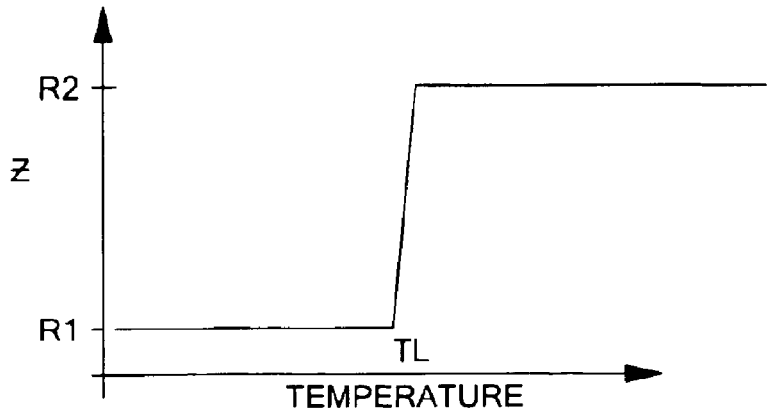
FIG. 6 is a graphical depiction of impedance versus temperature for a positive temperature coefficient element that can form a part of the circuit of FIG. 5.

As is shown in FIG. 6 and known in the art, a PTC element has a first (resistive) impedance R1 at a first (lower) temperature range and a second (resistive) impedance R2, which can be significantly higher than the first impedance, at a second (higher) temperature range. In general, at some temperature Tc the PTC impedance dramatically changes from the first impedance R1 to the second impedance R2. In an exemplary embodiment, the Tc for the PTC is about 120° C., the cold impedance is about 1 kOhm and the voltage rating is 350 Vrms. One of ordinary skill in the art will readily appreciate that PTC characteristics can be selected to meet the needs of a particular application.

Figure 7A:
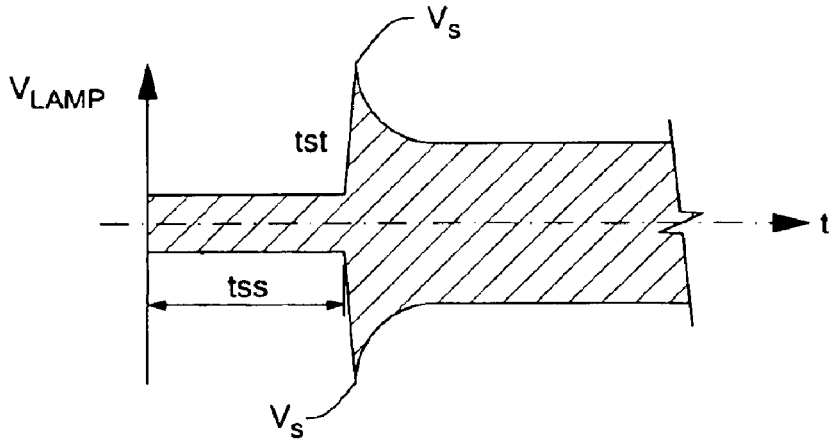
FIG. 7A is a graphical depiction of lamp voltage provided by the circuit of FIG. 5.
Figure 7B:
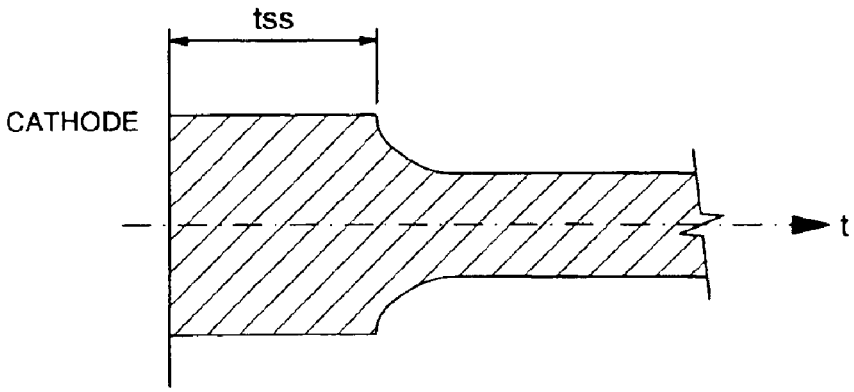
FIG. 7B is a graphical depiction of lamp cathode current provided by the circuit of FIG. 5.

As shown in FIG. 7A, a relatively low voltage Vlamp is applied to the lamp for a soft start time tss and a relatively high initial cathode current level Icathode, which can be referred to as a glow current, simultaneously flows through the lamp cathodes to warm them up for the soft start time tss, e.g., about 0.5 seconds, as shown in FIG. 7B. After the soft start time, the positive temperature coefficient element PTC warms up to the predetermined temperature Tc so that the PTC impedance increases to the second higher level R2. As the PTC element impedance rises dramatically to approach an open circuit characteristic, a strike voltage Vs is applied to the lamp. After the strike voltage is applied, operational lamp voltage Vlamp levels and cathode current Icathode levels are achieved.

The load inductor LR2 helps define the voltage across the lamp. It is well known that some loads, such as Compact Fluorescent Lamps (CFLs), have a relatively wide operating range. For example, while the current level may fall after dimming the lamp, the voltage across the lamp may not. As is also known, the load voltage has a natural tendency to increase as the operating frequency of the resonant circuit increases. The load inductor L2 resists this voltage elevation since its impedance rises with increases in frequency. Thus, the load inductor LR2 helps maintain a constant circuit operating frequency.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A circuit, comprising:

first and second input terminals for receiving an AC input signal;

an input inductor having a first end coupled to the first terminal and a second end;

a feedback path for transferring a signal from a load to the second end of the first inductor; and a blocking capacitor coupled in parallel with the input inductor forming a notch filter corresponding to a frequency of the load signal on the feedback path.

2. The circuit according to claim 1, further including first and second diodes coupled end-to-end across first and second rails, wherein the second end of the first inductor, which receives the load feedback, is coupled to a point between the first and second diodes.

3. The circuit according to claim 2, wherein the first and second diodes are coupled in a doubler configuration.

4. The circuit according to claim 1, further including a first capacitor coupled between the first and second terminals.

5. The circuit according to claim 1, further including a resonant inductor and a resonant capacitor fur energizing the load via first and second load terminals.

6. The circuit according to claim 5, wherein the feedback path extends from the second load terminal to the point between the second end of the first inductor.

7. The circuit according to claim 1, further including a resonant circuit for energizing a fluorescent lamp load.

8. The circuit according to claim 1, further including a full bridge rectifier, which has first, second, third, and fourth diodes, receiving the AC input signal, wherein the feedback path extends to AC terminals of the full bridge rectifier.

9. The circuit according to claim 8, further including a first and second series capacitors coupled end-to-end between the AC terminals of the full bridge rectifier, wherein the feedback path extends from a point between the first and second series capacitors.

10. The circuit according to claim 1, wherein the entire current to the load passes over the feedback path.

11. The circuit according to claim 1, further including a full bridge rectifier, which has first, second, third, and fourth diodes, receiving the AC input signal, wherein the feedback path extends to the full bridge rectifier.

12. The circuit according to claim 8, further including a second input inductor coupled to the second input terminal and a second blocking capacitor coupled in parallel with the second input inductor forming a further notch filter tuned to the frequency of the load signal on the feedback path.

13. A circuit, comprising:

a resonant circuit including a resonant inductor and a resonant capacitor; first and second diodes coupled end-to-end across first and second rails in a voltage doubler configuration;

a feedback path for transferring energy from the load to a feedback point between the first and second diodes;

first and second terminals for receiving and providing an AC input signal to the first and second diodes;

an input inductor coupled between the first terminal and the feedback point; and a blocking capacitor coupled in parallel with the input inductor, wherein the input inductor and the blocking capacitor have impedance values that provide a notch filter corresponding to an operating frequency of a load current transferred to the feedback point.

14. A circuit, comprising:

a resonant circuit including a resonant inductor and a resonant capacitor;

a full bridge rectifier having first and second diodes coupled end-to-end across first and second rails and third and fourth diodes coupled end-to-end across the first and second rails a feedback path for transferring energy from the load to a feedback point between the first and second diodes;

first and second terminals for receiving and providing an AC input signal to the first and second diodes;

a first input inductor coupled between the first terminal and the feedback point;

a first blocking capacitor coupled in parallel with the first input inductor, wherein the first input inductor and the first blocking capacitor have impedance values that provide a first notch filter corresponding to an operating frequency of a load current transferred to the feedback point; and a second blocking capacitor coupled in parallel with the second input inductor, wherein the second input inductor and the second blocking capacitor have impedance values that provide a second notch filter corresponding to the operating frequency of the load current transferred to the feedback point.

15. A method of minimizing electromagnetic conductance in a circuit receiving an AC input signal from a line and having feedback, comprising:

coupling a first blocking capacitor in parallel with a first input inductor coupled to a first input terminal for receiving the AC input signal;

providing a feedback signal from a load to the first input inductor, wherein the feedback signal has an operating frequency; and selecting an impedance for the first input inductor and an impedance for the first blocking capacitor such that the first input inductor and the blocking capacitor provide a first notch filter tuned to about the operating frequency of the feedback signal such that to energy from the feedback signal is substantially prevented from going back out onto the line.

16. The method according to claim 15, further including coupling the feedback signal to rectifying diodes, wherein the feedback signal promotes linear operation of the diodes.

17. The method according to claim 15, further including providing a second notch filter on a second input terminal for receiving the input AC signal.

18. The method according to claim 15, further including providing the feedback signal as the entire signal from the load.

19. The method according to claim 18, wherein the load corresponds to a fluorescent lamp.

* * * * *